US008519287B2

(12) United States Patent
Raabe et al.

(10) Patent No.: US 8,519,287 B2
(45) Date of Patent: Aug. 27, 2013

(54) CIRCUIT BREAKER WITH CONTROLLED EXHAUST

(75) Inventors: Rodney D. Raabe, Swisher, IA (US); David W. Barenz, Solon, IA (US); William J. Broghammer, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 322 days.

(21) Appl. No.: 12/946,209

(22) Filed: Nov. 15, 2010

(65) Prior Publication Data

US 2012/0120558 A1 May 17, 2012

(51) Int. Cl.

| | |
|---|---|
| ***H01H 9/02*** | (2006.01) |
| ***H01H 19/04*** | (2006.01) |
| ***H01H 13/04*** | (2006.01) |
| ***H01H 21/04*** | (2006.01) |

(52) U.S. Cl.
USPC ..... 200/306; 218/157

(58) Field of Classification Search
USPC ..... 200/304–306
See application file for complete search history.

(56) References Cited

U.S. PATENT DOCUMENTS

| | | | | |
|---|---|---|---|---|
| 3,773,994 | A | 11/1973 | Beatty | |
| 4,019,005 | A | 4/1977 | Michetti | |
| 4,549,242 | A * | 10/1985 | Nebon et al. | 361/115 |
| 4,559,425 | A | 12/1985 | Kirchesch et al. | |
| 4,963,849 | A * | 10/1990 | Kowalczyk et al. | 335/201 |
| 5,457,296 | A | 10/1995 | Neill et al. | |
| 6,198,063 | B1 * | 3/2001 | Kramer | 218/157 |
| 6,291,788 | B1 | 9/2001 | Doughty et al. | |
| 6,762,389 | B1 | 7/2004 | Crooks et al. | |
| 6,924,721 | B2 * | 8/2005 | Afshari et al. | 335/202 |

FOREIGN PATENT DOCUMENTS

| | | |
|---|---|---|
| EP | 2 120 244 A1 | 11/2009 |
| FR | 2 145 719 | 2/1973 |
| GB | 1 364 368 | 8/1974 |

OTHER PUBLICATIONS

International Search Report for Application No. PCT/US2011/057292, filed Oct. 21, 2011, mailed Apr. 26, 2012, 6 pages.
Written Opinion for International Application No. PCT/US2011/057292, filed Oct. 21, 2011, mailed Apr. 26, 2012, 8 pages.

* cited by examiner

*Primary Examiner* — Edwin A. Leon
*Assistant Examiner* — Lheiren Mae Caroc
(74) *Attorney, Agent, or Firm* — Nixon Peabody LLP

(57) ABSTRACT

A circuit breaker assembly includes a housing, a trip mechanism, a vent channel, and a chamber. The trip mechanism is positioned within the housing can causes a movable contact to separate from a second contact in response to detection by the circuit breaker assembly of an electrical fault. The vent channel is formed in the housing and positioned to exhaust gas and debris produced as the movable contact separates from the second contact during the electrical fault to an aperture in the housing. The chamber has a chamber housing coupled to the housing adjacent the aperture such that the chamber receives the gas and debris exiting the aperture.

22 Claims, 9 Drawing Sheets

CIRCUIT BREAKER WITH CONTROLLED EXHAUST

FIELD OF THE INVENTION

The present disclosure relates to circuit breaker assemblies, and, more particularly, to circuit breaker assemblies including a chamber for cooling and collecting gas and debris produced during a circuit interruption.

BACKGROUND

Vents relieve pressure in circuit breakers generated by ionized gas produced during a circuit interruption and can be situated near grounded metal that is part of the circuit-breaker enclosure or near a line-side bus, which is at a different voltage than the exiting gas. Vents also guide the debris and gas along a path so that they can be exhausted safely away from the circuit breaker. Debris generated during the circuit interruption can include metal particles that can be made molten by hot ionized gas. When the debris exits the circuit breaker, it can reduce the dielectric strength of the vent path and the through-air and over-surface dielectric spacings to grounded metal or bussing just outside the vent and promote a ground strike or cross-phase. Conventional ways of reducing debris exiting the circuit breaker include covering the vent opening with a screen or a perforated plate. But these obstructions increase the internal pressure generated during the circuit interruption, which can be undesirable. Additionally, some circuit breaker vents allow the generated gas and debris to exit the circuit breaker which can scorch and/or discolor an interior of a circuit-breaker panel in which the circuit breaker is coupled, which can also be undesirable.

BRIEF SUMMARY

The present invention couples a chamber including one or more baffles to a housing of a circuit breaker near an exit of a vent channel of the circuit breaker to provide an additional volume and length of the vent channel for produced gas and debris to travel prior to being expelled into an electrical enclosure. Such an additional volume provides more time for the gas to cool and provides more space to trap some of the debris therein as the gas and the debris are being expelled from the circuit breaker into the enclosure, which results in less debris being expelled from the circuit breaker. The additional time for cooling the gas and debris results in the gas and debris exiting the chamber at a lower temperature than otherwise, which minimizes or reduces any discoloration and/or scorching of the paint on the inside walls of the enclosure that might otherwise occur.

BRIEF DESCRIPTION OF THE DRAWINGS

The foregoing and other advantages of the invention will become apparent upon reading the following detailed description and upon reference to the drawings.

Figure 1:
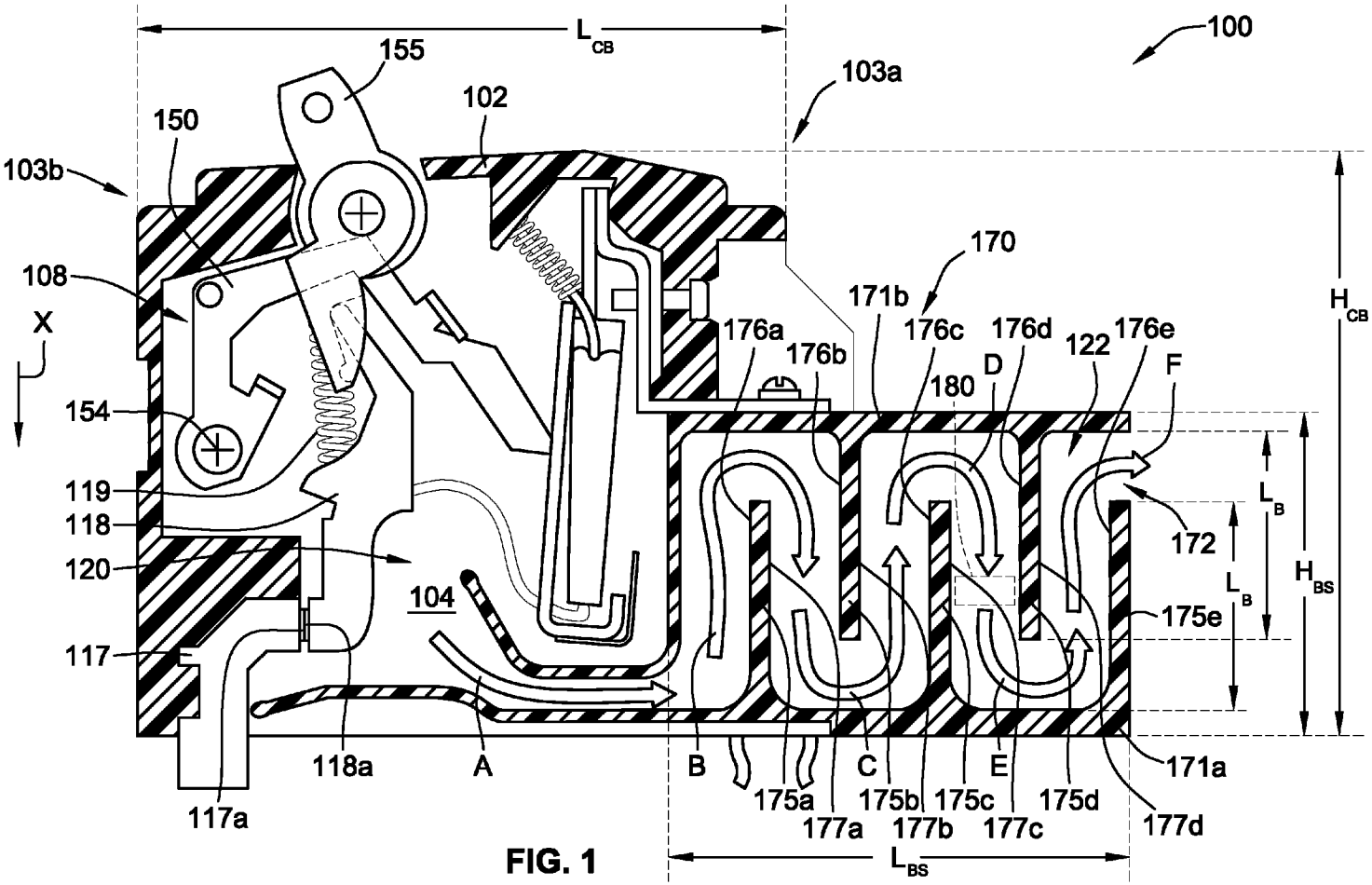
FIG. 1 is a side cross-sectional view of a circuit breaker assembly having a chamber that receives and directs gas and debris produced during a circuit interruption by the circuit breaker assembly.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is a cross-sectional view of a circuit breaker assembly 100 having a chamber 170 that receives and directs some of the gas and debris produced during a circuit interruption. The circuit breaker assembly 100 includes a housing 102, preferably composed of a molded plastic, that houses the various working components of the circuit breaker assembly 100. The chamber 170 is also preferably composed of a molded plastic, although other materials are contemplated. Conventionally, the circuit breaker assembly 100 includes a trip mechanism 108 that causes a movable contact 118*a* to separate from a stationary contact 117*a* in response to detection by the circuit breaker assembly 100 of an electrical fault. Some components of the traditional circuit breaker components are omitted or not described, however, these components, which may be found in, for example, the SQUARE D® miniature circuit breakers available from Schneider Electric, are not necessary for an understanding of aspects of the present disclosure.

The circuit breaker assembly 100 is a miniature circuit breaker ("MCB") with an overall thickness of the housing 102 being about 1 inch or smaller, preferably about ¾ inch, an overall height, $H_{CB}$, of the housing 102 being between about 2 inches and 3 inches, and an overall length, $L_{CB}$, of the housing 102 being between about 3 inches and 4 inches. The chamber 170 has an overall thickness of about 1 inch or smaller, preferably about ¾ inch to match the thickness of the housing 102, an overall height, $H_{Bs}$, between about 1 inch and about 2 inches, and an overall length, $L_{BS}$, of between about 1 inch and about 3 inches, although various other lengths and dimensions of the housing 102 and the chamber 170 are contemplated by the scope of the present disclosure.

The housing 102 has a front surface or load end 103*a* and a back surface or line end 103*b*. Current flows into the circuit breaker assembly 100 and into the stationary contact 117*a* via a stationary conductive blade 117. The moveable contact 118*a* is removably coupled to the stationary contact 117*a*. The moveable contact 118*a* is fixed to a moveable conductive blade 118. The moveable conductive blade 118 is moveable between an "on" position (as shown in FIG. 1), where the moveable contact 118*a* abuts or electrically connects with the stationary contact 117*a*, and an "off" position (not shown), where the moveable contact 118*a* is disconnected or removed from contact with the stationary contact 117*a*.

The moveable conductive blade 118 is coupled to a trip lever 150 via a spring 119. The moveable conductive blade 118 is pivotally coupled to a handle 155. The handle 155 has an "on" position (as shown in FIG. 1) and an "off" position (not shown). The on position of the handle 155 can also be referred to as a "latched" or "engaged" position. The on and off positions of the handle 155 correspond to the on and off positions of the moveable conductive blade 118. Thus, switching the handle 155 from the off position to the on position causes the moveable conductive blade 118 to swing from the off position to the on position, thereby completing the electrical circuit in the circuit breaker assembly 100. Tripping the circuit breaker assembly 100 from the on position to a "tripped" position causes the trip lever 150 to rotate about a pivot point 154 in the direction of arrow X, thereby causing the spring 119 to cause the moveable conductive blade 118 to swing away from and out-of-contact with the stationary contact 117*a*, thereby breaking the flow of current across the circuit breaker assembly 100.

A vent channel 104 originates in the housing 102 and extends towards the chamber 170. The circuit breaker assembly 100 includes a front pressure area 120 and a back pressure area 122. The front pressure area 120 is positioned proximate the movable contact 118*a* when it is disengaged from the stationary contact 117*a*. A gas pressure exerted upon the front pressure area 120 is greater than a gas pressure exerted upon the back pressure area 122, which is distal (farther away) from the front pressure area 120 relative to the source of the debris produced when the movable contact 118*a* separates from the stationary contact 117*a*.

The vent channel 104 allows gas and debris—produced as the moveable contact 118*a* is separated from the stationary contact 117*a* during an electrical fault—to flow from the high pressure area 120 in the housing 102, through the chamber 170, and towards an exhaust opening 172 in the chamber 170. The vent channel 104 and the chamber 170 form a path with a multitude of sections for the produced gas and debris to flow along. The path has a generally serpentine shape that forces the produced gas and debris to change flow directions at least two times before exiting the exhaust opening 172 in the chamber 170.

The chamber 170 is positioned adjacent to the front surface 103*a* of the housing 102. The chamber 170 can be directly or indirectly coupled to the front surface 103*a* of the housing 102 in a permanent or removable fashion. Alternatively, the chamber 170 can be formed as an integral portion of the housing 102 of the circuit breaker assembly 100. The chamber 170 includes two opposing walls 171*a,b* and five separate and spaced apart baffles 175*a-e* therein, although it is contemplated that the chamber 170 can include at least two separate and spaced apart baffles. Preferably, each baffle 175*a-e* is generally shaped as an elongated, substantially-straight finger, although various other shapes and dimensions are possible, such as, for example, an elongated, curved or wavy finger or a device (such as a plate, wall, or screen) to deflect, check, or regulate flow of a fluid, light, and/or sound.

The first, third, and fifth baffles 175*a,c,e* extend from a first one of the walls 171*a* and the second and fourth baffles 175*b,d* extend from a second one of the walls 171*b* in a staggered fashion. By "staggered fashion" it is meant that each one of the baffles 175*a-e* extends from a different point along the length, $L_{BS}$, of the chamber 170. A length, $L_B$, of each one of the baffles 175*a-e* is greater than half of a spacing distance between the two walls 171*a-b*. Preferably, the length, $L_B$, of each baffle 175*a-e* is about two-thirds of the spacing distance between the two walls 171*a,b*. As such, a portion of the length, $L_B$, of the first, third, and fifth baffles 175*a,c,e* partially overlaps with a portion of the length, $L_B$, of the second and fourth baffles 175*b,d*. Thus, the exhausting gas and debris are forced to change directions due to the baffles 175*a-e* at least twice before exiting the exhaust opening 172. That is, the exhausting gas and debris must change directions to get around the baffles 175*a-e* in the chamber 170 of the circuit breaker assembly 100.

For example, gas and debris produced in the front pressure area 120 flow generally in a first direction indicated by arrow A towards the chamber 170, then change directions to flow around the first baffle 175*a* as indicated by arrow B, then change directions to flow around the second baffle 175*b* as indicated by arrow C, then change directions to flow around the third baffle 175*c* as indicated by arrow D, then change directions to flow around the fourth baffle 175*d* as indicated by arrow E, then change directions to flow around the fifth baffle 175*b* and towards the exhaust opening 172 as indicated by arrow F. In this example, the gas and debris are forced to change direction by about 180 degrees by each one of the baffles 175*a-d*.

Additionally, the gas and debris follow the path along a first side 176*a-e* of each baffle 175*a-e* in a first direction and then change directions to follow the path along a second opposing side 177*a-d* of the baffles 175*a-d* in a second direction that is opposite the first direction. Specifically, the gas and debris enter the chamber 170 in the direction of arrow A and flow along the first side 176*a* of the first baffle 175*a*, then change directions to flow between the second side 177*a* of the first baffle 175*a* and the first side 176*b* of the second baffle 175*b*, then change directions to flow between the second side 177*b* of the second baffle 175*b* and the first side 176*c* of the third baffle 175*c*, then change directions to flow between the second side 177*c* of the third baffle 175*c* and the first side 176*d* of the fourth baffle 175*d*, then change directions to flow between the second side 177*d* of the fourth baffle 175*d* and the first side 176*e* of the fifth baffle 175*e* towards the exhaust opening 172.

One or more optional filters 180 can be included in the chamber 170 of the circuit breaker assembly 100. The filters 180 can be loosely placed between the baffles 175*a-e* (as shown in FIG. 1) or rigidly attached between the baffles 175*a-e* using one or more attachment means, such as, for example, glue, screws, staples, tape, etc. The optional filter 180 can be a spray foam that fills substantially the entire interior volume of the chamber 170 and/or the vent channel 104. Alternatively, the filter 180 can include a semi-rigid fiberglass material and/or a woven or mesh material made from ceramic or stainless steel fibers. The optional one or more filters 180 can be positioned to filter the exhausting gas and debris to prevent at least some of the debris from exiting the exhaust opening 172.

Figure 2A:
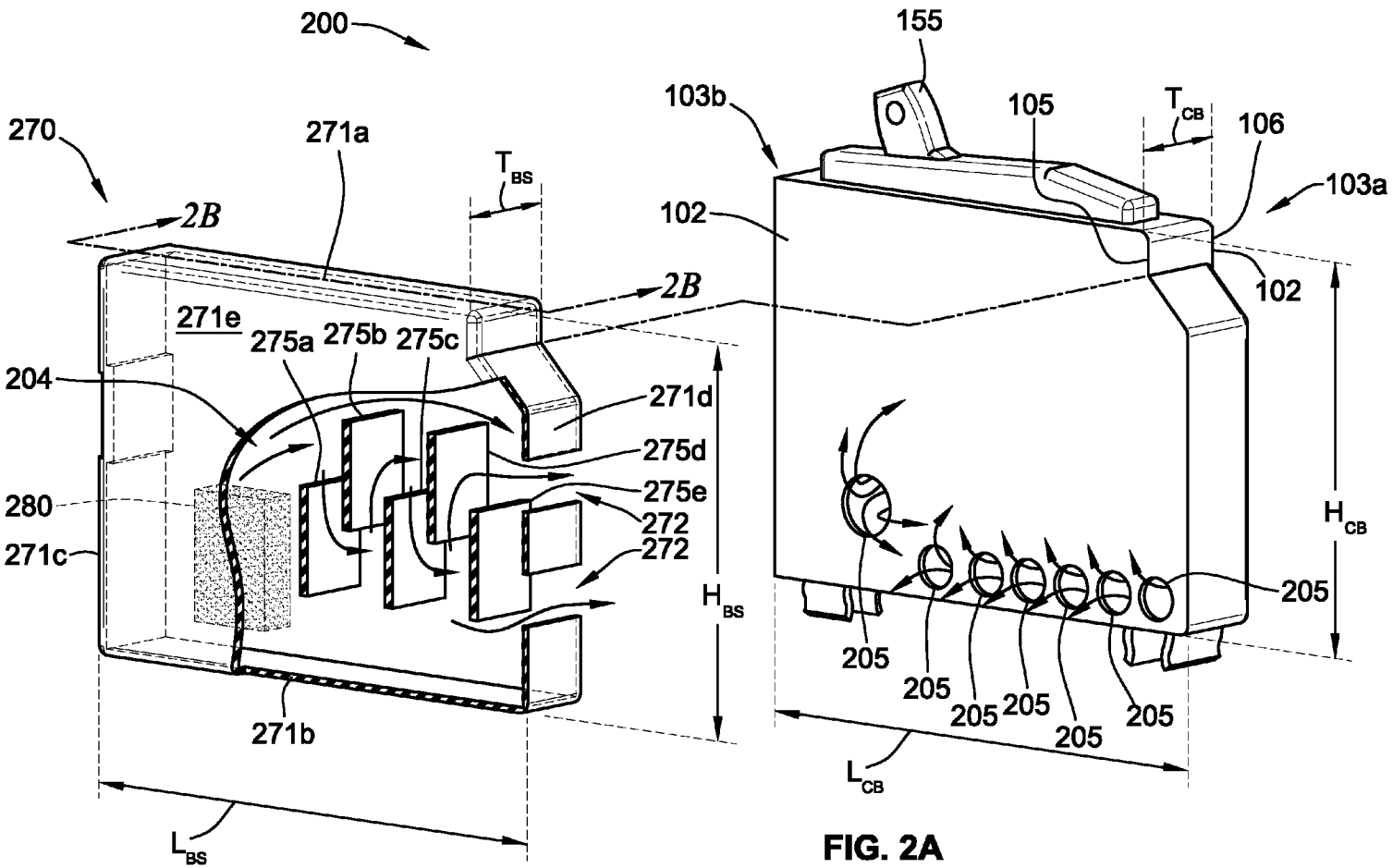
FIG. 2A is a partially exploded partial perspective view of a circuit breaker assembly having a chamber that receives and directs gas and debris produced during a circuit interruption by the circuit breaker assembly.
Figure 2B:
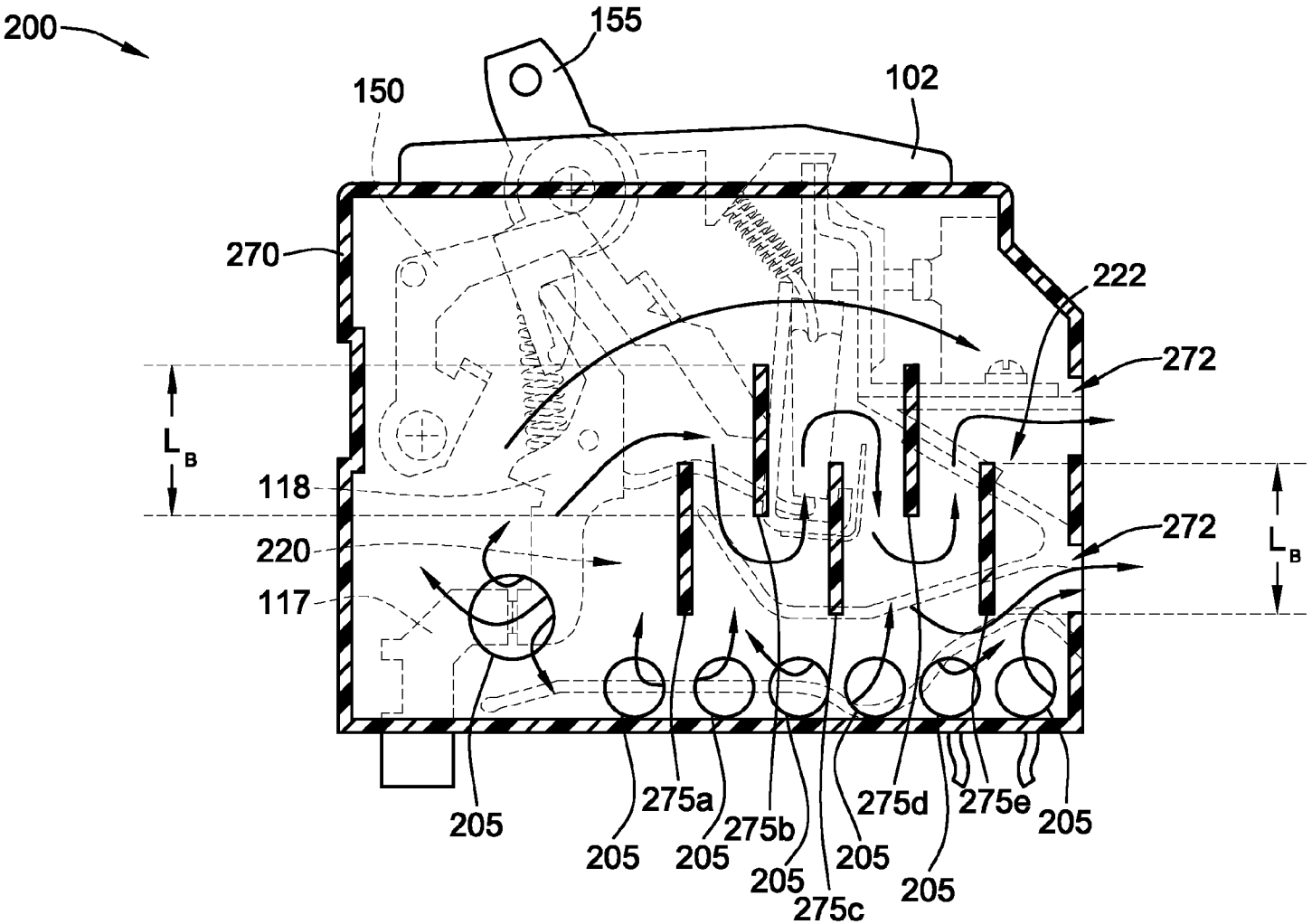
FIG. 2B is a side cross-sectional view of the circuit breaker assembly of FIG. 2A.

Referring to FIGS. 2A and 2B, a circuit breaker assembly 200 is shown, where like reference numbers are used for like components previously described in reference to the circuit breaker assembly 100 and FIG. 1. FIG. 2A is a partially exploded partial perspective view of the circuit breaker assembly 200 having a chamber 270 that receives and directs some of the gas and debris produced during a circuit interruption. FIG. 2B is a side cross-sectional view of the circuit breaker assembly 200. The circuit breaker assembly 200 includes a housing 102 that houses the various working components (e.g., trip mechanism 108) of the circuit breaker assembly 200 in the same, or similar fashion, as described above in reference to FIG. 1.

As described above, the overall thickness, $T_{CB}$, of the housing 102 is about 1 inch or smaller, preferably about ¾ inch, the overall height, $H_{CB}$, of the housing 102 is between about 2 inches and 3 inches, and the overall length, $L_{CB}$, of the housing 102 is between about 3 inches and 4 inches. As best seen in FIG. 2A, the chamber 270 has an overall thickness, $T_{BS}$, an overall height, $H_{BS}$, and an overall length, $L_{BS}$, that are substantially the same as the overall thickness, $T_{CB}$, the overall height, $H_{CB}$, and the overall length, $L_{CB}$, of the housing 102.

A vent channel 204 originates in the housing 102 and extends towards the chamber 270. The circuit breaker assembly 200 includes a front pressure area 220 and a back pressure area 222. The vent channel 204 allows gas and debris—produced as a moveable contact 118*a* is separated from a stationary contact 117*a* during an electrical fault—to flow from the front pressure area 220 in the housing 102, through apertures 205 in the housing 102, into the chamber 270, and towards exhaust openings 272. The vent channel 204 and the chamber 270 include a multitude of sections that form a multitude of paths for the produced gas and debris to flow along.

For example, the gas and debris can initially flow from the front pressure area 220 into the chamber 270 via one of the multitude of apertures 205. From that point of entry into the chamber 270, the gas and debris can follow one of a multitude of paths from the various apertures 205 to the exhaust openings 272, such as, for example, the gas and debris can flow around, between, and/or under baffles 275*a-e*. However, at least one of the paths has a generally serpentine shape that causes the produced gas and debris to change flow directions at least two times before exiting the exhaust openings 272 in the chamber 270.

The housing 102 has a front surface or load end 103*a*, a back surface or line end 103*b*, a first side surface 105, and a second opposing side surface 106. The chamber 270 is positioned adjacent to the first side surface 105 of the housing 102. The chamber 270 can be directly or indirectly coupled to the first side surface 105 of the housing 102 in a permanent or removable fashion. Alternatively, the chamber 270 can be formed as an integral portion of the housing 102 of the circuit breaker assembly 200. The chamber 270 includes a top wall 271*a*, an opposing bottom wall 271*b*, two opposing side walls 271*c,d*, and a cover 271*e* that connects the walls 271*a-d*.

Protruding from a inside surface of the cover 271*e* are the five separate and spaced apart baffles 275*a-e*, although it is contemplated that the chamber 270 can include at least two separate and spaced apart baffles. Preferably, each baffle 275*a-e* is generally shaped as an elongated, substantially-straight finger, although various other shapes and dimensions are possible, such as, for example, an elongated, curved or wavy finger or a device (such as a plate, wall, or screen) to deflect, check, or regulate flow of a fluid, light, and/or sound.

The baffles 275*a-e* are positioned within the chamber 270 in a staggered fashion to cause the gas and debris to change flow directions at least two times before exiting the exhaust openings 272 in the chamber 270. By "staggered fashion" it is meant that each one of the baffles 275*a-e* extends from a different point along the length, $L_{BS}$, of the chamber 270 although the baffles 275*a-e* are not physically attached to either of the top or the bottom walls 271*a,b*. Additionally, a portion of the length, $L_B$, of the first, third, and fifth baffles 275*a,c,e* partially overlaps with a portion of the length, $L_B$, of the second and fourth baffles 275*b,d*. Thus, the exhausting gas and debris are forced to change directions due to the baffles 275*a-e* at least twice before exiting the exhaust openings 272. That is, the exhausting gas and debris must change directions to get around the baffles 275*a-e* in the chamber 270 of the circuit breaker assembly 200.

One or more optional filters 280 can be included in the chamber 270 of the circuit breaker assembly 200. The filters 280 can be positioned within the vent channel 204, loosely placed between the baffles 275*a-e* (in a similar fashion as shown in FIG. 1), and/or rigidly attached between the baffles 275*a-e* using one or more attachment means, such as, for example, glue, screws, staples, tape, etc. The optional one or more filters 280 can be positioned to filter the exhausting gas and debris to prevent at least some of the debris from exiting the exhaust openings 272.

Figure 3A:
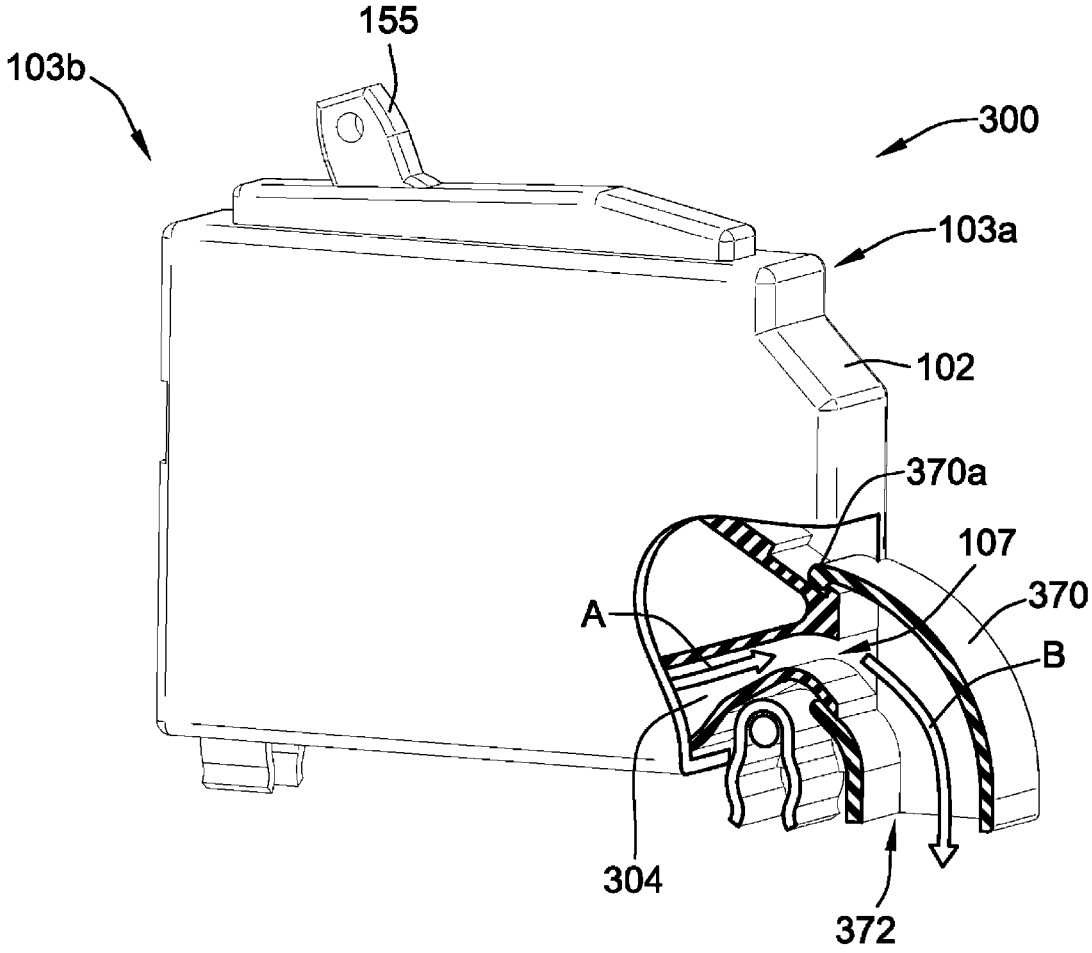
FIG. 3A is a partial perspective view of a circuit breaker assembly having a chamber that receives and directs gas and debris produced during a circuit interruption by the circuit breaker assembly.
Figure 3B:
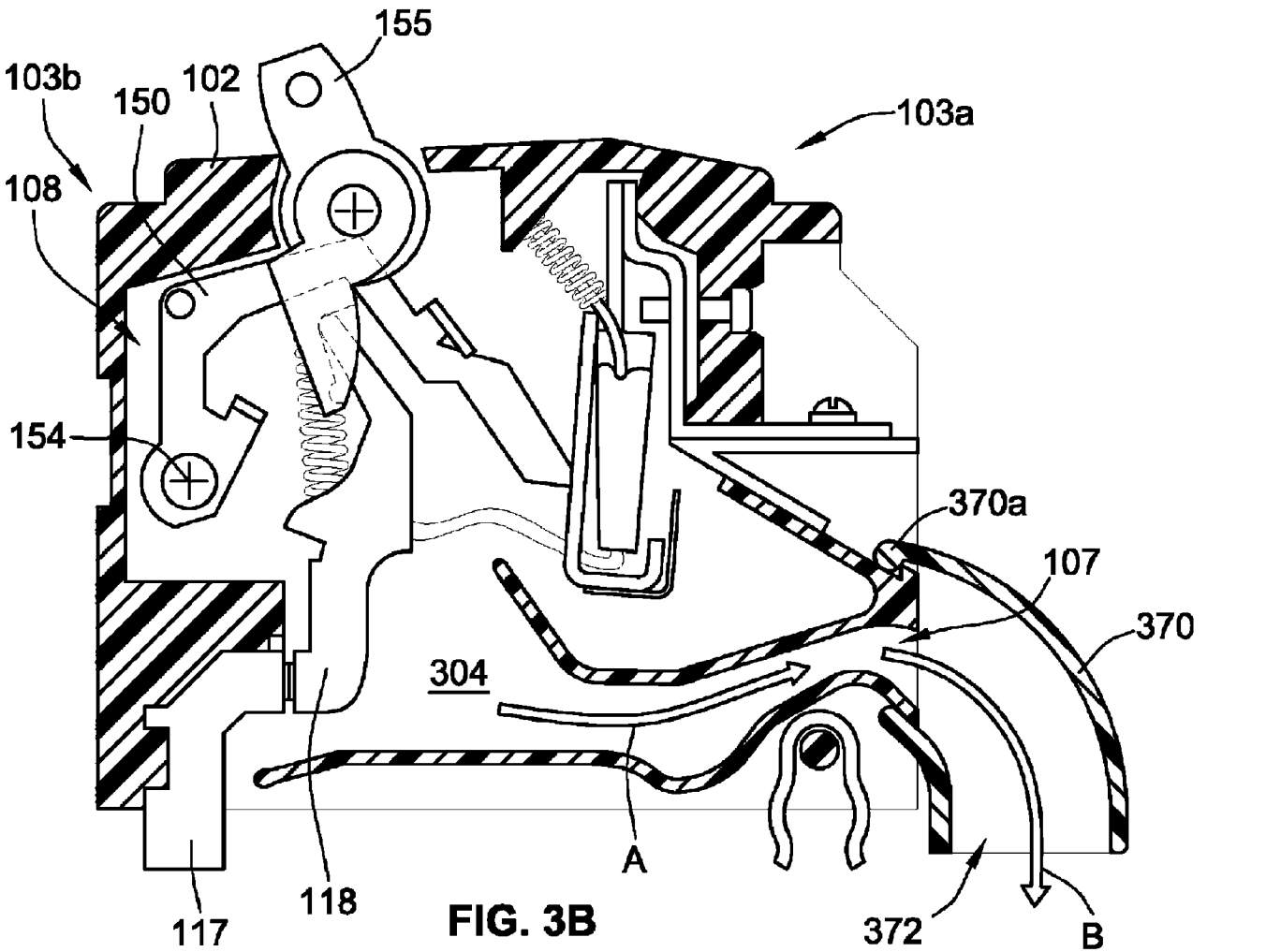
FIG. 3B is a cross-sectional view of the circuit breaker assembly of FIG. 3A.

Referring to FIGS. 3A and 3B, a circuit breaker assembly 300 is shown, where like reference numbers are used for like components previously described in reference to the circuit breaker assembly 100 and FIG. 1. FIG. 3A is a partial perspective view of the circuit breaker assembly 300 having a chamber 370 that receives and directs gas and debris produced during a circuit interruption. FIG. 3B is a side cross-sectional view of the circuit breaker assembly 300. The circuit breaker assembly 300 includes a housing 102 that houses the various working components (e.g., trip mechanism 108) of the circuit breaker assembly 300 in the same, or similar fashion, as described above in reference to FIG. 1.

The housing 102 has a front surface or load end 103*a* and a back surface or line end 103*b*. As shown in FIG. 3A, the chamber 370 is positioned adjacent to the front surface 103*a* of the housing 102. The chamber 370 can be directly or indirectly coupled to the front surface 103*a* of the housing 102 in a permanent or removable fashion. The chamber 370 is removably coupled to the housing 102 via a clip or snap-on interface. That is, the chamber 370 includes a lipped edge 370*a* that is configured to snap-on a corresponding surface on the housing 102 to removably couple the chamber 370 with the housing 102. Alternatively, the chamber 370 can be formed as an integral portion of the housing 102 of the circuit breaker assembly 300.

A vent channel 304 is formed in the housing 102 and positioned to exhaust gas and debris—produced as a moveable contact 118*a* is separated from a stationary contact 117*a* during an electrical fault—through an aperture 107 in the housing 102, into the chamber 370, and towards an exhaust opening 372. The vent channel 304 and the chamber 370 include a multitude of sections that form a path for the produced gas and debris to flow along.

Gas and debris is exhausted via the vent channel 304 in the direction of arrow A towards the aperture 107, where the all of the gas and debris exiting the aperture 107 is received by the chamber 370. The chamber 370 redirects all of the gas and debris exiting the aperture 107 from the general direction of arrow A (a general horizontal direction) to the general direction of arrow B (a general vertical direction). Thus, gas and debris that would ordinarily be expelled directly out of the housing 102 in the general direction of arrow A towards an inside surface of a side wall of an enclosure of a load center containing the circuit breaker assembly 300 (e.g., side walls 502*d,e* of the enclosure 502 in FIG. 5), is redirected generally downward towards an inside surface of a base of the enclosure (e.g., base 502*a* in FIG. 5).

The directions of arrows A and B are offset by at least about 75 degrees from each other. Preferably, the direction of arrow B is about 90 degrees offset from the direction of arrow A. An optional filter (not shown) can be included in the chamber 370 to prevent at least some of the debris from being expelled through the exhaust opening 372.

Figure 4A:
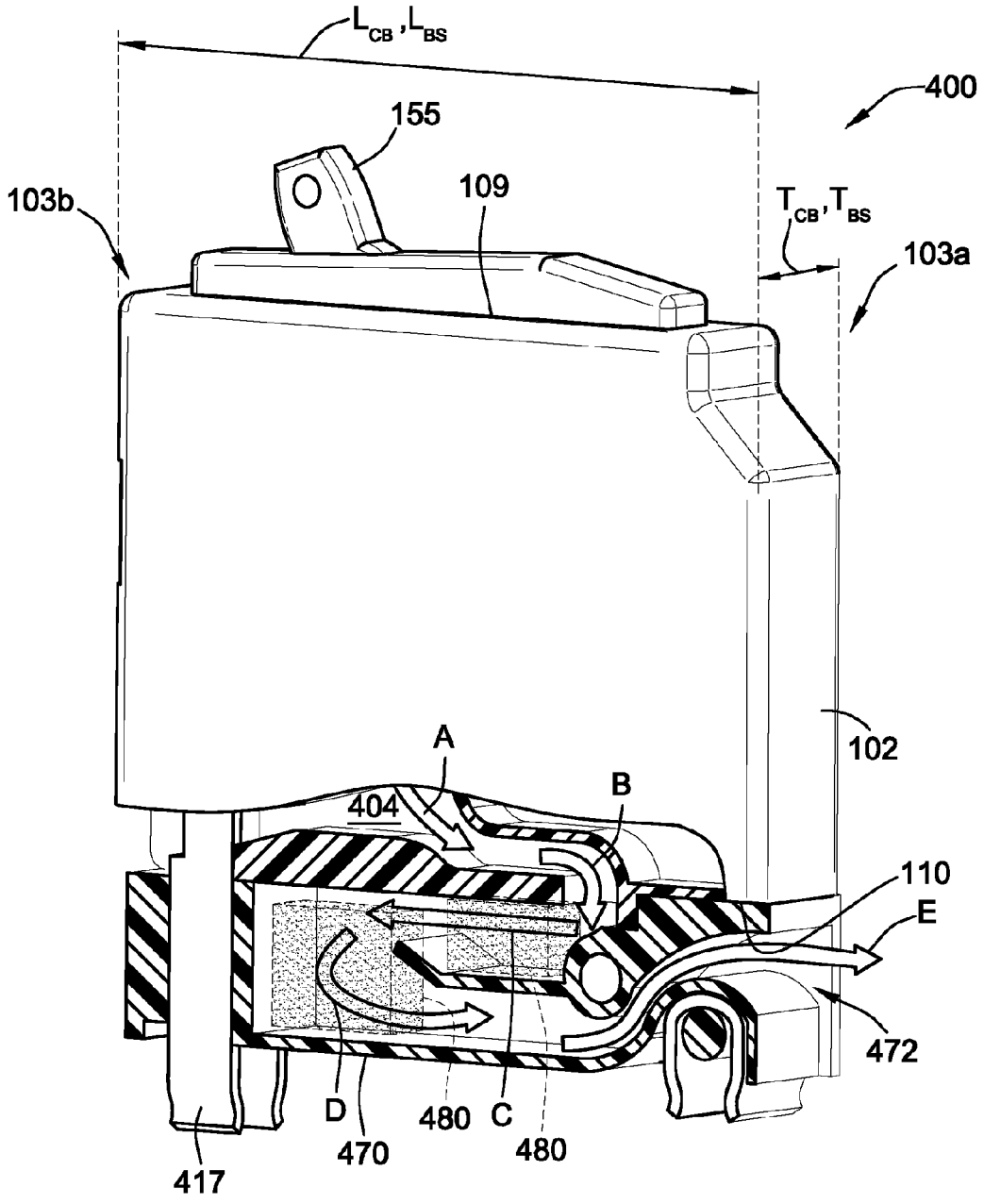
FIG. 4A is a partially exploded partial perspective view of a circuit breaker assembly having a chamber that receives and directs gas and debris produced during a circuit interruption by the circuit breaker assembly.
Figure 4B:
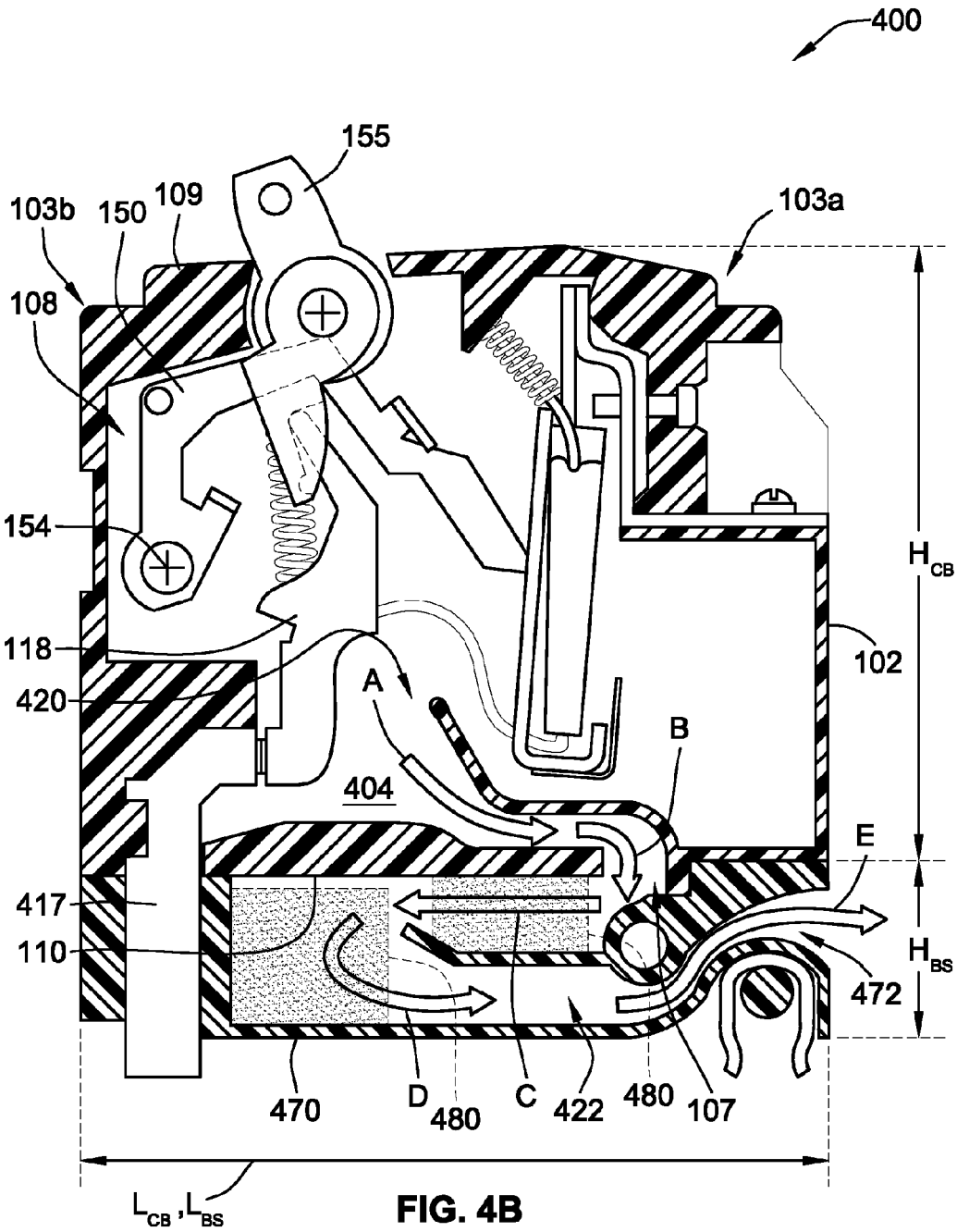
FIG. 4B is a cross-sectional view of the circuit breaker assembly of FIG. 4A.

Referring to FIGS. 4A and 4B, a circuit breaker assembly 400 is shown, where like reference numbers are used for like components previously described in reference to the circuit breaker assembly 100 and FIG. 1. FIG. 4A is a partially exploded partial perspective view of the circuit breaker assembly 400 having a chamber 470 that receives and directs some of the gas and debris produced during a circuit interruption. FIG. 4B is a side cross-sectional view of the circuit breaker assembly 400. The circuit breaker assembly 400 includes a housing 102 that houses the various working components (e.g., trip mechanism 108) of the circuit breaker assembly 400 in the same, or similar fashion, as described above in reference to FIG. 1.

As described above, the overall thickness, $T_{CB}$, of the housing 102 is about 1 inch or smaller, preferably about ¾ inch, the overall height, $H_{CB}$, of the housing 102 is between about 2 inches and 3 inches, and the overall length, $L_{CB}$, of the housing 102 is between about 3 inches and 4 inches. As best seen in FIG. 4A, the chamber 470 has an overall thickness, $T_{BS}$ and an overall length, $L_{BS}$, that are substantially the same as the overall thickness, $T_{CB}$ and the overall length, $L_{CB}$, of the housing 102. The overall height, $H_{BS}$, is between about ½ inch and about 2 inches. According to some aspects, the overall height, $H_{BS}$, of the chamber 470 is less than half of the height, $H_{CB}$, of the housing 102 (FIG. 4B).

The housing 102 has a front surface or load end 103*a*, a back surface or line end 103*b*, a top surface 109, and a bottom surface 110. As shown in FIG. 4A, the chamber 470 is positioned adjacent to the bottom surface 110 of the housing 102. The chamber 470 can be directly or indirectly coupled to the bottom surface 110 of the housing 102 in a permanent or removable fashion. Alternatively, the chamber 470 can be formed as an integral portion of the housing 102 of the circuit breaker assembly 400.

A vent channel 404 originates in the housing 102 and extends towards the chamber 470. The circuit breaker assembly 400 includes a front pressure area 420 and a back pressure area 422. The vent channel 404 allows gas and debris—produced as a moveable contact 118*a* is separated from a stationary contact 117*a* during an electrical fault—to flow from the front pressure area 420, through an aperture 107 in the housing 102, into the chamber 470, and towards an exhaust opening 472. The vent channel 404 and the chamber 470 include a multitude of sections that form a path for the produced gas and debris to flow along. The path has a generally serpentine shape that forces the produced gas and debris to change flow directions at least two times before exiting the exhaust opening 472 in the chamber 470. The stationary contact 117*a* is attached to a stationary conductive blade 417. The stationary conductive blade 417 is similar to the stationary conductive blade 117 described above in reference to FIG. 1, however, the stationary conductive blade 417 extends through the housing 102 and into the chamber 470 as shown.

For example, gas and debris produced in the front pressure area 420 flow generally in a first direction indicated by arrow A towards the chamber 470, then change directions to flow through the aperture 107 in the housing 102 as indicated by arrow B, then change directions to flow in a first direction indicated by arrow C, then change directions to flow in a second opposite direction as indicated by arrow D, then flow towards the exhaust opening 472 as indicated by arrow E. In this example, the gas and debris are forced to change direction by about 180 degrees by the chamber 470 before exiting the exhaust opening 472.

One or more optional filters 480 can be included in the chamber 470 and/or the vent channel 404 of the circuit breaker assembly 400. The filters 480 can be loosely placed and/or rigidly attached using one or more attachment means, such as, for example, glue, screws, staples, tape, etc. The optional one or more filters 480 can be positioned to filter the exhausting gas and debris to prevent at least some of the debris from exiting the exhaust openings 472.

Figure 5:
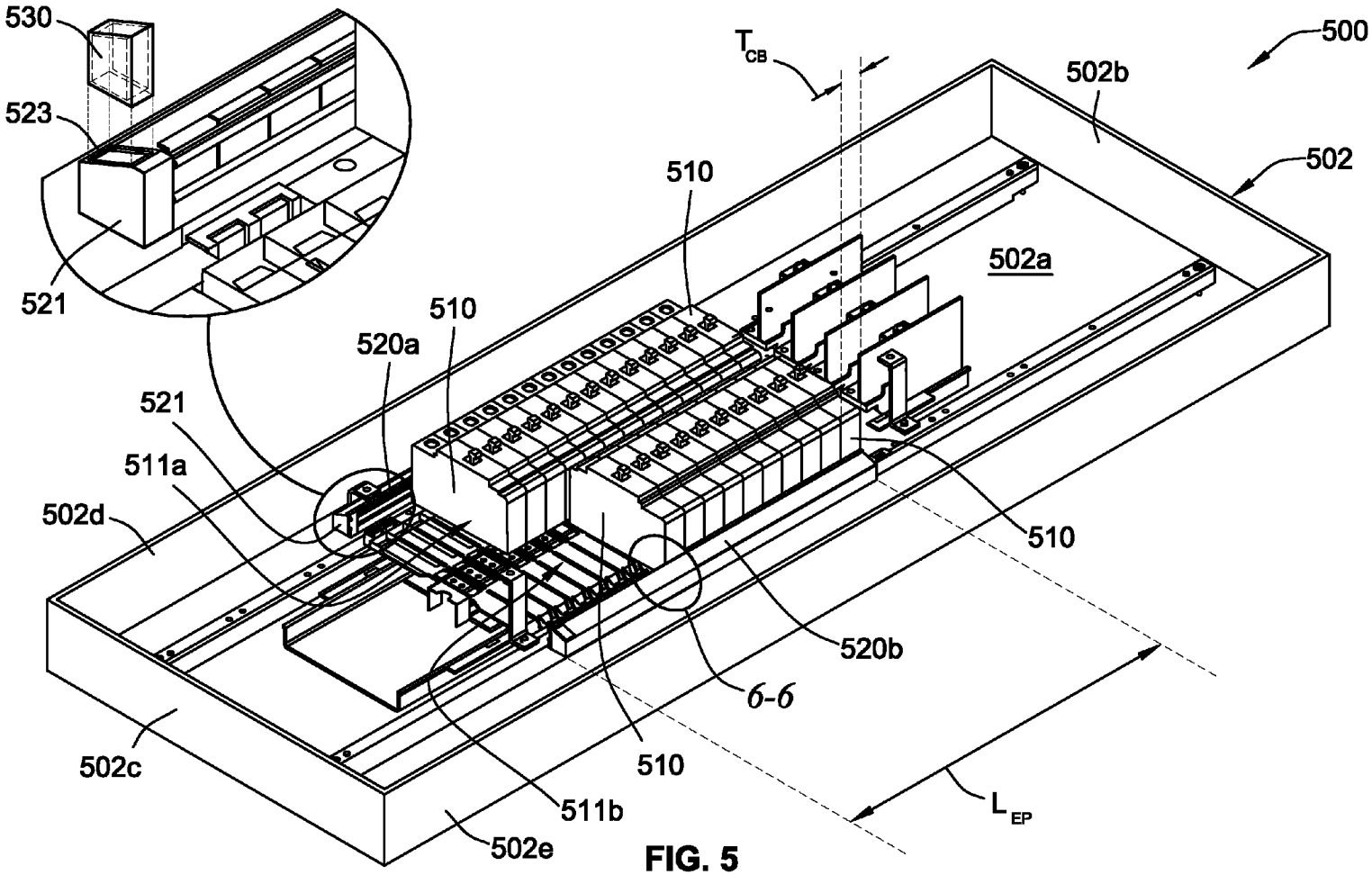
FIG. 5 is a partial perspective view of a load center having exhaust plenums that receive and direct gas and debris produced during a circuit interruptions by a multitude of circuit breaker assemblies.
Figure 6:
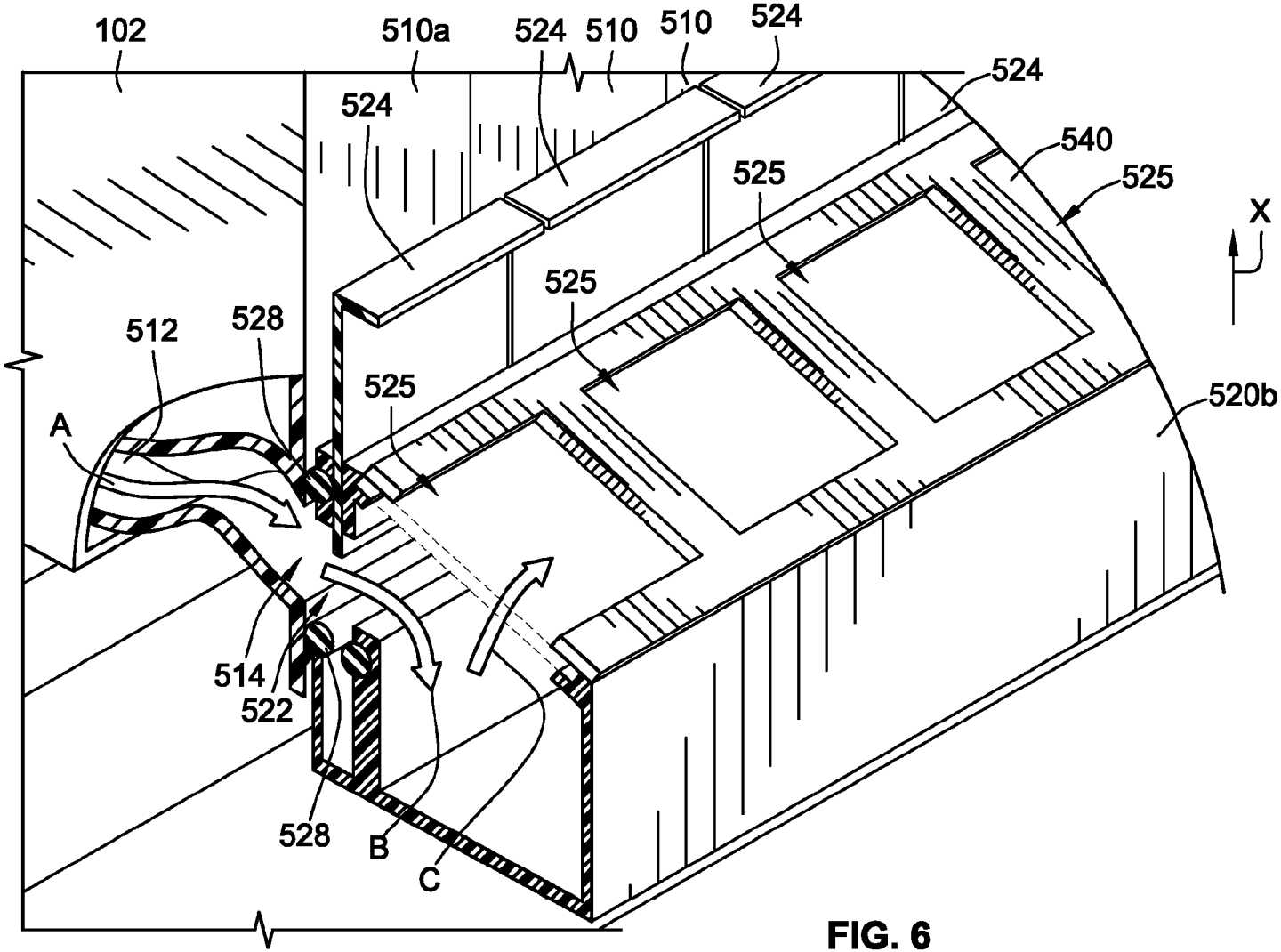
FIG. 6 is an enlarged cross-sectional perspective view of a portion of the load center and exhaust plenum of FIG. 5.

Referring generally to FIGS. 5 and 6, a load center 500 having exhaust plenums or chambers 520*a,b* is shown. FIG. 5 illustrates a partial perspective view of the load center 500 having the exhaust plenums 520*a,b* that receive and direct gas and debris produced during circuit interruptions by a multitude of circuit breaker assemblies 510. FIG. 6 is an enlarged cross-sectional perspective view of a portion of the load center 500 to better illustrate the interoperability between the circuit breaker assemblies 510 and the exhaust plenums 520*a,b*.

The load center 500 includes an electrical enclosure 502, two rows of circuit breaker assemblies 511*a,b*, and one of the exhaust plenums 520*a,b* for each of the rows of circuit breaker assemblies 511*a,b* therein. Each of the rows 511*a,b* includes a portion of the multitude of circuit breaker assemblies 510. For example, as shown, the first row 511*a* includes thirteen circuit breaker assemblies 510 and the second row 511*b* includes ten circuit breaker assemblies 510. Various numbers and arrangements of rows and circuit breaker assemblies are contemplated and possible with the exhaust plenums 520*a,b* of the present disclosure.

Each one of the circuit breaker assemblies 510 at least includes a trip mechanism (e.g., trip mechanism 108) to cause a moveable contact (e.g., moveable contact 118*a*) to separate from a stationary contact (e.g., stationary contact 117*a*) in response to detection by the circuit breaker assembly 510 of an electrical fault. Additionally, each one of the circuit breaker assemblies 510 includes a vent channel 512 (FIG. 6) formed in a housing 102 of the circuit breaker assembly 510 and positioned to exhaust gas and debris produced as the moveable contact separates from the stationary contact during the electrical fault towards an exit opening 514 (FIG. 6) in the housing 102 of the circuit breaker assembly 510.

Specifically, responsive to a circuit breaker assembly 510*a* detecting an electrical fault, gas and debris flows in the direction of arrow A along the vent channel 512 towards the exit opening 514 in the housing 102 of the circuit breaker assembly 510*a*, then substantially all of the gas and debris exiting the exit opening 514 flows into the exhaust plenum 520*b* in the direction of arrow B through an intake opening 522, which aligns with the exit openings 514 of each of the circuit breaker assemblies 510 in the second row 511*b*. Then, the exhaust plenum 520*b* redirects the gas and at least a portion of the debris that entered via the intake opening 522 in a generally horizontal direction to exit the exhaust plenum 520*b* via one or more exhaust openings 525 (FIG. 6) in a generally vertical direction as shown by arrow C.

The exhaust plenum 520*a,b* can optionally include a removable filter 540 that abuts the one or more exhaust openings 525 such that at least a portion of the exiting debris is collected by the removable filter 540. The removable filter 540 can be made from a variety of materials, such as, for example, fiberglass.

The exhaust plenum 520*b* can optionally include a removable debris tray 530 positioned adjacent to or on top of a bottom 521 of the exhaust plenum 520*b* such that some of the exhausted debris is collected on the tray 530. For example, some heavier debris that might not be carried with the gas towards the exhaust openings 525 and captured/collected by the removable filter 540 can fall onto the removable debris tray 530. The debris tray 530 can be removed through slot 523 in the exhaust plenum 520*a* for inspection and or replacement.

As shown in FIG. 5, the enclosure 502 includes a base 502*a*, a top wall 502*b*, a bottom wall 502*c*, and two opposing side walls 502*d,e*. The enclosure can also include a lid or cover (not shown) to protect the contents therein. The cover can include one or more access slots (not shown) to provide access to the removable filter 540 and/or the debris tray 530 for inspection and/or replacement. Each of the exhaust plenums 520*a,b* is positioned within the enclosure 502 adjacent one of the rows of circuit breaker assemblies 511*a,b* such that the intake opening 522 (FIG. 6) of the exhaust plenum 520*b* aligns with the exit openings 514 of each circuit breaker assembly 510 included in the row 511*b*. The exhaust plenum 520*a,b* can be removably coupled to the base 502*a* of the enclosure 502 via one or more attachment means, such as, for example, glue, screws, nuts and bolts, tape, welding etc., such that the entire exhaust plenum 520*a,b* or one or more portions thereof can be readily removed for servicing and/or replacement.

The exhaust plenum 520*a,b* is provided with a length, $L_{EP}$, such that the exhaust plenum 520*a,b* is long enough to span the thicknesses, $T_{CB}$, of each circuit breaker assembly 510 in an adjacent row of circuit breaker assemblies 510. For example, if a row of circuit breaker assemblies includes 10 circuit breaker assemblies, each having a thickness of 1 inch, then the exhaust plenum would at least be 10 inches long.

Each exhaust plenum 520*a,b* can include one or more gaskets 528 positioned between the housings of the circuit breaker assemblies 510 and the exhaust plenum 520*a,b*. The gaskets 528 aid in sealing the exhaust plenums 520*a,b* around the exit openings 514 of the circuit breaker assemblies 510 to better direct the flow of gas and debris from the vent channels 512 to the exhaust plenums 520*a,b*.

The exhaust plenum 520*a,b* includes a multitude of moveable or removable empty slot fillers 524. Each one of the empty slot fillers 524 is moved or pulled in the direction of arrow X to allow access to a corresponding portion of the intake opening 522 for each slot of the load center 500 that is fitted or filled with a circuit breaker assembly 510. The empty slot fillers 524 can be pulled upward into the position shown in FIG. 6 or completely removed from the load center 500.

While the circuit breaker assemblies 100, 200, 300, 400, and 510 of the present disclosure are shown and described as a single pole circuit breaker assemblies, it is contemplated that the circuit breaker assemblies 100, 200, 300, 400, and 510 can be three-pole circuit breaker assemblies wherein three poles are assembled in a common circuit breaker housing. In such three-pole configurations, the three poles are interconnected with a common trip bar such that tripping one pole causes the other poles to trip. However, for ease of illustration, the present disclosure focuses on single-pole circuit breaker assemblies, although the disclosure can be applied to any number of poles in a circuit breaker assembly.

While the chamber 170 is described as being made of a molded plastic, it is contemplated that the baffles 175*a-e* can be made from, inter alia, a filter material (e.g., fiberglass) such that the baffles 175*a-e* not only act to direct flow of the gas and debris but also to filter at least some of the debris. For example, the baffles 175*a-e* can have a solid core made from plastic and fiberglass filter covers such that the baffles 175*a-e* cause the gas to change flow directions but also capture at least some of the debris.

While the baffles 275*a-e* are shown and described as not being physically attached to either of the walls 271*a,b*, it is contemplated that the first, third, and fifth baffles 275*a,c,e* can be physically attached to the bottom wall 271*b* and the second and fourth baffles 275*b,d* can be physically attached to the top wall 271*a* such that a portion of the length, $L_B$, of the first, third, and fifth baffles 275*a,c,e* partially overlaps with a portion of the length, $L_B$, of the second and fourth baffles 275*b,d* in the same, or similar, fashion as baffles 175*a,c,e* overlap with baffles 175*b,d*.

As described above, each of the above described chambers 170, 270, 370, 470, and 520*a,b* is coupled to one or more vent channels to form one or more paths, which increases the volume and length of the vent channel to provide an additional volume and length of the vent channel for produced gas and debris to travel prior to being expelled into an electrical enclosure. This additional volume and length provides additional time for the gas and debris to cool and collect within the chambers themselves and/or within one or more filters located therein, which minimizes or reduces any discoloration and/or scorching of the paint on the inside walls of the enclosure and reduces the amount of expelled debris.

Words of degree such as "substantially" or "about" are used herein in the sense of "at, or nearly at, given the process, control, and material limitations inherent in the stated circumstances" and are used herein to keep the unscrupulous infringer from taking advantage of unqualified or absolute values stated for exemplary embodiments.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker assembly, comprising:

a housing;

a trip mechanism within the housing for causing a movable contact to separate from a second contact in response to detection by the circuit breaker assembly of an electrical fault; and a chamber having at least two separate and spaced apart baffles therein, wherein the housing and the chamber form at least one path originating in the housing and extending through the chamber and towards an exhaust opening in the chamber, the at least one path being positioned to exhaust gas and debris produced as the movable contact separates from the second contact during the electrical fault from the housing, the at least one path having a plurality of sections along which the gas and the debris change directions at least twice due to the at least two baffles before exiting the exhaust opening, and wherein the chamber causes at least some of the exiting gas and debris to travel along at least a first portion of the at least one path in a first direction and along a second portion of the at least one path in a second direction that is opposite the first direction.

2. The circuit breaker assembly of claim 1, wherein the chamber is positioned adjacent a front surface of the housing.

3. The circuit breaker assembly of claim 1, wherein the at least one path is exactly one serpentine path.

4. The circuit breaker assembly of claim 1, wherein each baffle causes the gas and debris to change direction by about 180 degrees.

5. The circuit breaker assembly of claim 1, wherein the chamber includes two opposing walls, a first one of the baffles extending from a first one of the walls and a second one of the baffles extending from a second one of the walls in a staggered fashion such that a length of the first baffle partially overlaps with a length of the second baffle.

6. The circuit breaker assembly of claim 5, wherein the at least two separate and spaced apart baffles is at least four separate and spaced apart baffles, a third one of the baffles extending from the first wall and a fourth one of the baffles extending from the second wall in a staggered fashion such that a length of the third baffle partially overlaps with a length of the fourth baffle and with the length of the second baffle.

7. The circuit breaker assembly of claim 5, wherein the two opposing walls are spaced apart a spacing distance and wherein the length of the first and the second baffles is greater than half of the spacing distance.

8. The circuit breaker assembly of claim 7, wherein the length of the first and the second baffles is about two-thirds of the spacing distance.

9. The circuit breaker assembly of claim 7, wherein each of the baffles is an elongated, substantially-straight finger.

10. The circuit breaker assembly of claim 1, wherein the chamber is positioned adjacent a side surface of the housing, the housing having one or more apertures aligned with one or more corresponding apertures in the chamber such that the gas and the debris exhaust from the housing, through the apertures, through the chamber, and to the exit opening.

11. The circuit breaker assembly of claim 1, wherein the housing has a thickness, a length, and a height that are approximately equal to a thickness, a length, and a height of the chamber.

12. The circuit breaker assembly of claim 1, wherein the housing and the chamber are separately formed and configured to be coupled together.

13. The circuit breaker assembly of claim 12, wherein the housing and the chamber are removably coupled together.

14. The circuit breaker assembly of claim 1, further comprising a filter positioned in at least a portion of the at least one path such that at least some of the debris is collected in the filter instead of exiting the circuit breaker assembly.

15. A circuit breaker assembly, comprising:

a housing;

a trip mechanism within the housing for causing a movable contact to separate from a second contact in response to detection by the circuit breaker assembly of an electrical fault;

a vent channel formed in the housing and positioned to exhaust gas and debris produced as the movable contact separates from the second contact during the electrical fault to an aperture in the housing; and a chamber having a chamber housing coupled to the housing adjacent the aperture such that the chamber receives the exhausted gas and debris that exits the aperture, the chamber being configured to redirect the exhausted gas and debris that exits the aperture from a first direction to a second direction, wherein the first and the second directions being at least about 75 degrees apart.

16. The circuit breaker assembly of claim 15, wherein the chamber is positioned adjacent to a bottom surface of the housing.

17. The circuit breaker assembly of claim 16, wherein the housing has a thickness and a length that are approximately equal to a thickness and a length of the chamber, and wherein the chamber has a height that is less than half of a height of the housing.

18. A load center, comprising:

an enclosure for receiving a plurality of circuit breakers, each of the circuit breakers including:

(i) a housing;

(ii) a trip mechanism within the housing for causing a movable contact to separate from a second contact in response to detection by the circuit breaker of an electrical fault; and (iii) a vent channel formed in the housing and positioned to exhaust gas and debris produced as the movable contact separates from the second contact during the electrical fault to an exit opening in the housing;

a chamber coupled to the enclosure and positioned adjacent at least a portion of the circuit breakers such that an intake opening of the chamber aligns with the exit openings of the at least a portion of the circuit breakers to receive substantially all of the gas and the debris exiting the exit openings of the at least a portion of the circuit breakers; and one or more gaskets positioned between the housings of the at least a portion of the circuit breakers and the chamber.

19. The load center of claim 18, wherein the chamber includes a removable filter abutting one or more exhaust openings in the chamber, the removable filter being positioned in the chamber such that a portion of the debris is collected in the removable filter.

20. The load center of claim 19, wherein the chamber redirects the gas that enters the chamber in a generally horizontal direction via the intake opening to exit the chamber via the one or more exhaust openings in a generally vertical direction.

21. The load center of claim 18, wherein the chamber further includes a removable debris tray positioned in the chamber such that a portion of the debris is collected in the removable debris tray.

22. The load center of claim 18, wherein a length of the chamber spans the thicknesses of the at least a portion of the circuit breakers.

* * * * *